US009578408B2

(12) United States Patent
Pan

(10) Patent No.: US 9,578,408 B2
(45) Date of Patent: Feb. 21, 2017

(54) HEADPHONE DEVICE

(71) Applicant: Primax Electronics Ltd., Neihu, Taipei (TW)

(72) Inventor: Yung-Tai Pan, Taipei (TW)

(73) Assignee: PRIMAX ELECTRONICS LTD., Taipei (TW)

( * ) Notice: Subject to any disclaimer, the term of this patent is extended or adjusted under 35 U.S.C. 154(b) by 83 days.

(21) Appl. No.: 14/639,703

(22) Filed: Mar. 5, 2015

(65) Prior Publication Data

US 2016/0198251 A1 Jul. 7, 2016

(30) Foreign Application Priority Data

Jan. 5, 2015 (TW) ..... 104100056 A

(51) Int. Cl.
*H04R 25/00* (2006.01)
*H04R 1/10* (2006.01)

(52) U.S. Cl.
CPC ..... *H04R 1/1041* (2013.01); *H04R 1/105* (2013.01)

(58) Field of Classification Search
CPC ..... H04R 1/1041; H04R 5/033
See application file for complete search history.

(56) References Cited

U.S. PATENT DOCUMENTS 7,945,297 B2 * 5/2011 Philipp ..... H04R 1/1041 455/557
8,760,310 B2 * 6/2014 Rosener ..... H04M 1/05 340/573.4
2006/0233413 A1 * 10/2006 Nam ..... H04R 1/1041 381/380
2010/0197360 A1 * 8/2010 Namgoong ..... H04M 1/6058 455/569.1
2014/0146976 A1 * 5/2014 Rundle ..... H04R 1/1083 381/71.6

* cited by examiner

*Primary Examiner* — Joseph Saunders, Jr.
(74) *Attorney, Agent, or Firm* — Kirton McConkie; Evan R. Witt

(57) ABSTRACT

A headphone device includes a sound outputting part and a sensor. The sound outputting part includes a case, a main board, a driving unit, a baffle plate and an ear pad. The sensor is installed on the baffle plate, uncovered by the ear pad and connected with the main board. If the human ear is sensed by the sensor, the main board judges that the headphone device is worn by the user. If the human ear is not sensed by the sensor, the main board judges that the headphone device is not worn by the user. According to the result of judging whether the headphone device is worn by the user, the playback of the audio content of an electronic device connected with the headphone device is correspondingly controlled.

11 Claims, 6 Drawing Sheets

HEADPHONE DEVICE

FIELD OF THE INVENTION

The present invention relates to a headphone device, and more particularly to a circumaural headphone device.

BACKGROUND OF THE INVENTION

Generally, the user may use a headphone device to listen to an audio content of an electronic device or answer a call. When the headphone device is removed by the user, the user may leave for a time period and forget to temporarily cease playing the audio content. After the headphone device is worn again by the user, the playback progress has advanced. Since the user has to re-adjust the playback progress, the operating method is not user-friendly. Moreover, if the headphone device is not used for a long term and the user forgets to disable the wireless connection between the headphone device and the electronic device or forgets to turn off the headphone device, the usage time of the headphone device is shortened since the battery of the headphone device continually provides electrical energy to the headphone device when the headphone device is not used. Consequently, the availability of headphone device is reduced.

Therefore, there is a need of providing an improved headphone device for automatically allowing the electronic device to temporarily cease playing the audio content when the headphone device is removed and automatically allowing the electronic device to continuously play the audio content when the headphone device is worn by the user again. Moreover, when the headphone device is not used for a long term, the headphone device is capable of disabling the wireless connection between the headphone device and the electronic device or turning off the headphone device, so that the usage time of the headphone device is extended.

SUMMARY OF THE INVENTION

An object of the present invention provides a circumaural headphone device, which is user-friendly, power-saving and easily fabricated.

Another object of the present invention provides a circumaural headphone device. An optical sensor is installed on a baffle plate to sense whether the headphone device is worn by the user. Moreover, according to the result of judging whether the headphone device is worn by the user, the playback of the audio content of an electronic device connected with the headphone device is correspondingly controlled.

In accordance with an aspect of the present invention, there is provided a headphone device. The headphone device includes at least one sound outputting part and a sensor. Each sound outputting part includes a case, a main board, a driving unit, a baffle plate and an ear pad. The main board is accommodated within the case. The driving unit is accommodated within the case and connected with the main board and allows the headphone device to generate sound. The baffle plate covers the driving unit and avoids sound field interference. The ear pad covers the baffle plate and has a ring-shaped structure. When the headphone device is worn by a user, the ear pad is in contact with a corresponding human ear. The sensor is installed on the baffle plate, uncovered by the ear pad and connected with the main board. If the human ear is sensed by the sensor, the main board judges that the headphone device is worn by the user.

If the human ear is not sensed by the sensor, the main board judges that the headphone device is not worn by the user.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1:
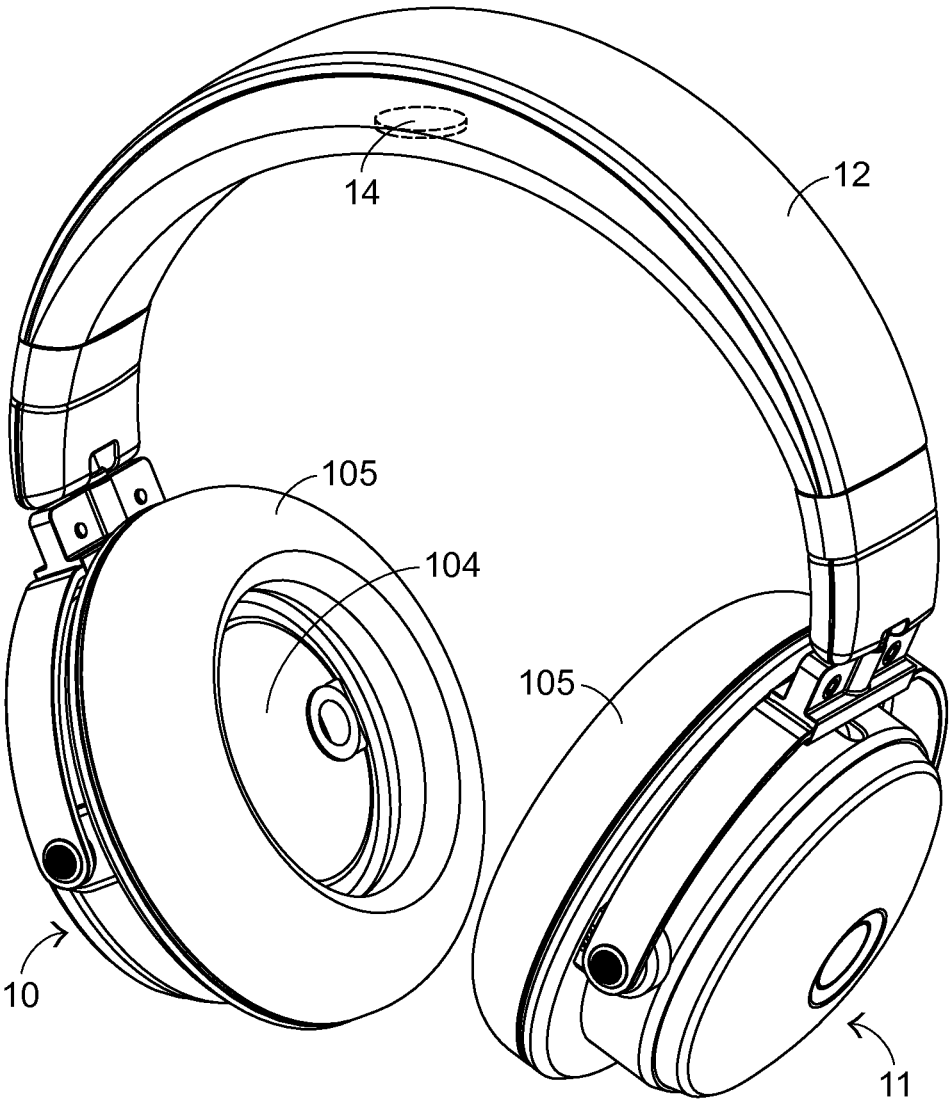
FIG. 1 is a schematic perspective view illustrating a headphone device according to a first embodiment of the present invention.
Figure 2:
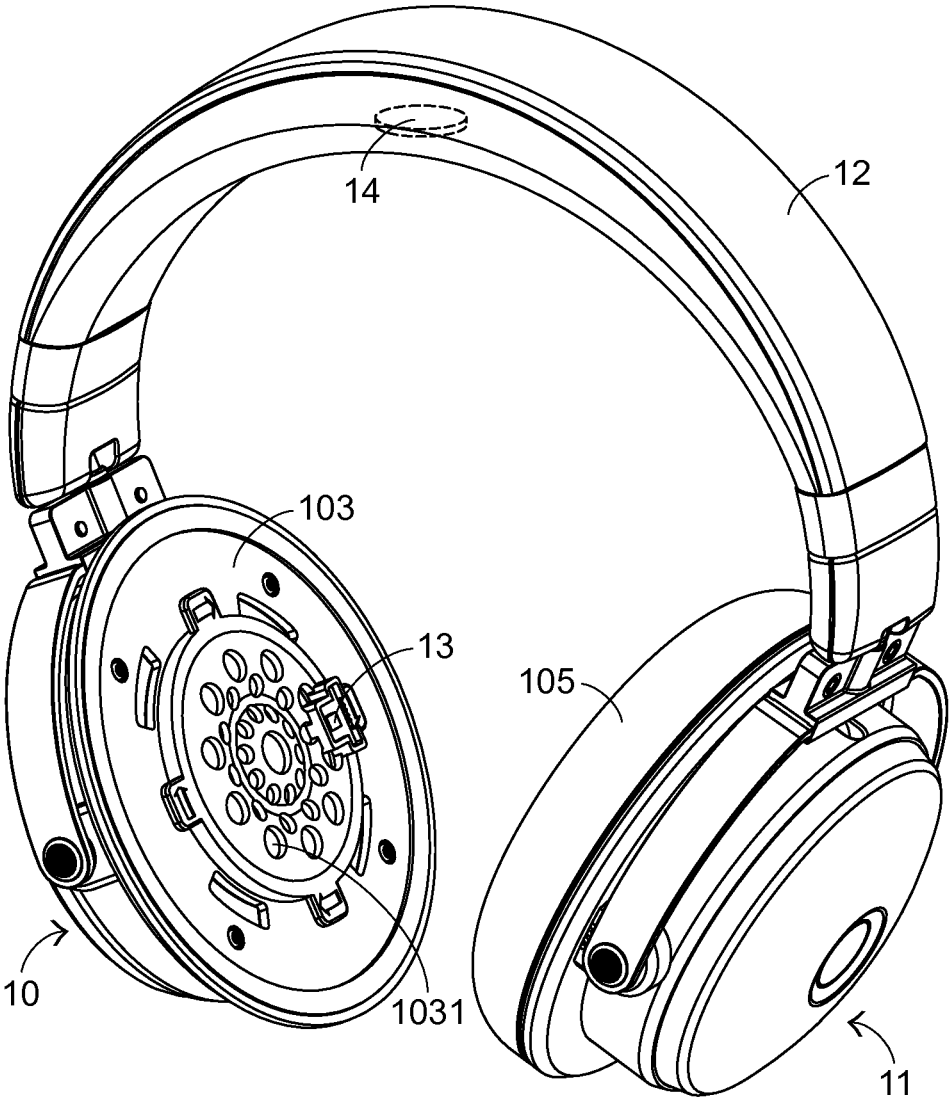
FIG. 2 is a schematic perspective view illustrating the headphone device according to the first embodiment of the present invention, in which an ear pad of a sound outputting part is removed.
Figure 3:
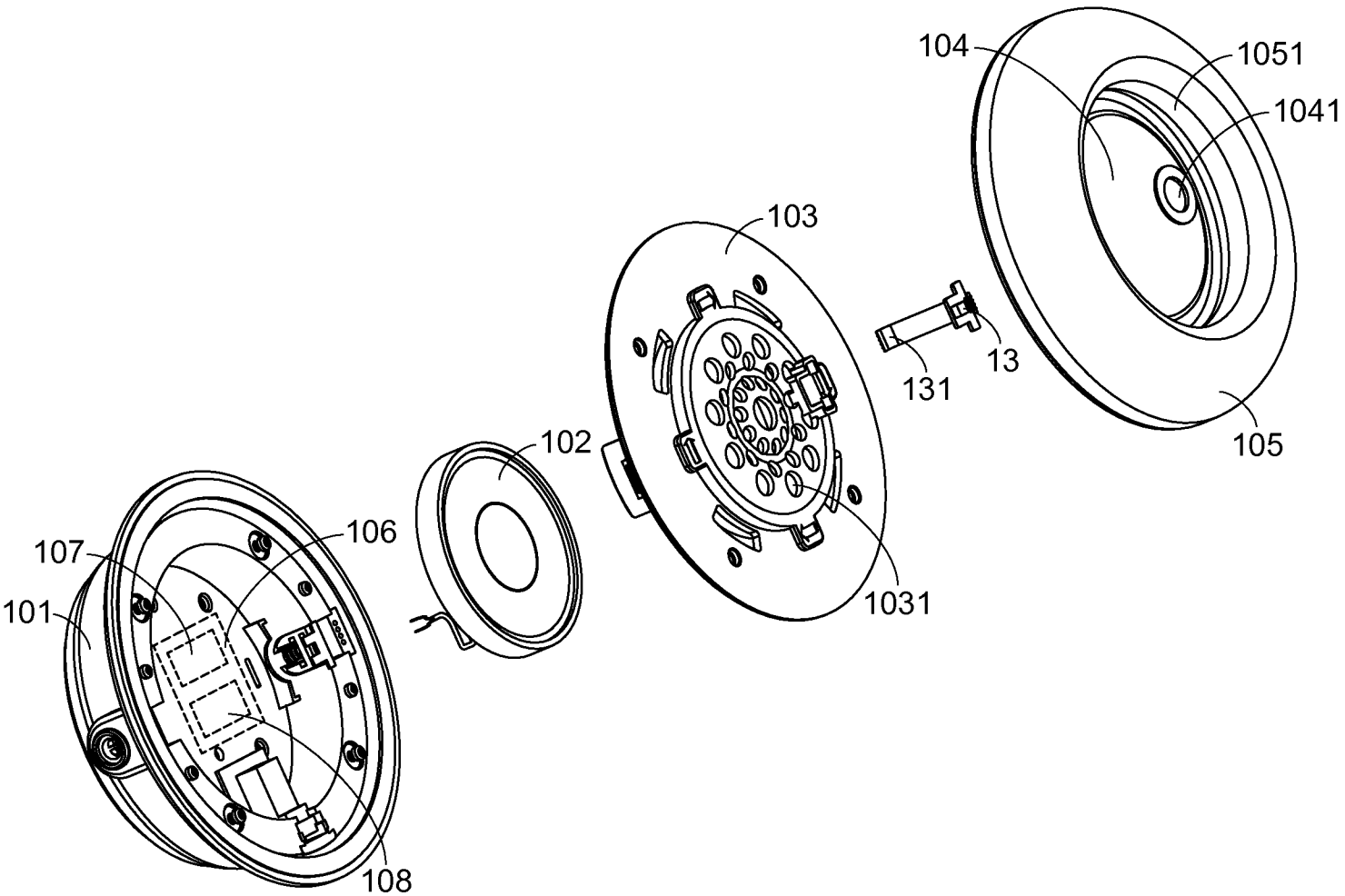
FIG. 3 is a schematic exploded view illustrating a sound outputting part of the headphone device according to the first embodiment of the present invention.

The present invention provides a headphone device. Hereinafter, the components of the headphone device will be illustrated with reference to FIGS. 1, 2 and 3. FIG. 1 is a schematic perspective view illustrating a headphone device according to a first embodiment of the present invention. FIG. 2 is a schematic perspective view illustrating the headphone device according to the first embodiment of the present invention, in which an ear pad of a sound outputting part is removed. FIG. 3 is a schematic exploded view illustrating a sound outputting part of the headphone device according to the first embodiment of the present invention.

The headphone device 1 comprises two sound outputting parts 10 and 11, a head band 12 and a sensor 13. The sound outputting parts 10 and 11 are connected with each other through the head band 12. The sensor 13 is installed on the sound outputting part 10. When the headphone device 1 is in a usage status, two human ears are surrounded by the sound outputting parts 10 and 11, respectively. In this embodiment, the left human ear is surrounded by the sound outputting part 10, and the right human ear is surrounded by the sound outputting part 11.

Since the two sound outputting parts 10 and 11 have the identical structures, only the sound outputting part 10 is shown in FIG. 3. Hereinafter, the components of the sound outputting part 10 will be illustrated in more details. The sound outputting part 10 comprises a case 101, a driving unit 102, a baffle plate 103, a covering plate 104 and an ear pad 105. For assembling the sound outputting part 10, a main board 106 of the headphone device 1 is firstly accommodated within the case 101, wherein a wireless communication module 107 and a power module 108 are connected with the main board 106.

Then, the driving unit 102 is accommodated within the case 101 and connected with the main board 106. The driving unit 102 is covered by the baffle plate 103. The sensor 13 is disposed on the baffle plate 103. A connecting port 131 is penetrated through the baffle plate 103 and connected with the main board 106. The operating principle of the driving unit 102 is well known to those skilled in the art. The driving unit 102 is used to emit sound. Generally, the driving unit 102 comprises a magnetic element, a vibration plate and a voice coil. The driving unit 102 is one of a dynamic type driver, a balanced armature driver and a capacitive driver. The operating principles of the driving unit 102 will be illustrated as follows. After an electric signal from an electronic device (e.g. a computer or a mobile phone) is received by the driving unit 102, the vibration plate is subjected to vibration in response to the flowing current. Consequently, the ambient air around the vibration plate is vibrated. When the air vibration is sensed by the tympanum of the human ear, the sound corresponding to the air vibration is heard by the human ear. Moreover, when the vibration plate is subjected to vibration, the air molecules at a front side and a rear side of the driving unit 102 are vibrated. Consequently, sound fields at the front side and the rear side of the driving unit 102 are generated. In this embodiment, the baffle plate 103 is used for separating the front sound field and the rear sound field so as to avoid the interference between the front sound field and the rear sound field. Moreover, for allowing the sound to pass through the baffle plate 103, the baffle plate 103 comprises plural openings 1031.

Afterwards, the baffle plate 103 is covered by the covering plate 104. Consequently, the user cannot be in direct contact with the baffle plate 103. The ear pad 105 is connected with the covering plate 104 and sheathed around the human ear. Moreover, the covering plate 104 has a perforation 1041 corresponding to the sensor 13. Consequently, the sensor 13 is exposed through the perforation 1041. In this embodiment, the sensor 13 is an optical sensor. The sensor 13 is configured to emit a light beam to the human ear and receive the reflected light beam from the human ear. For achieving a sensing function, the sensor 13 is located at a position where the sensor 13 is not blocked by the ear pad 105. Preferably but not exclusively, an inner portion of the ear pad 105 is stuffed with a sponge material, and an outer surface of the ear pad 105 is made of leather or cloth.

Figure 4:
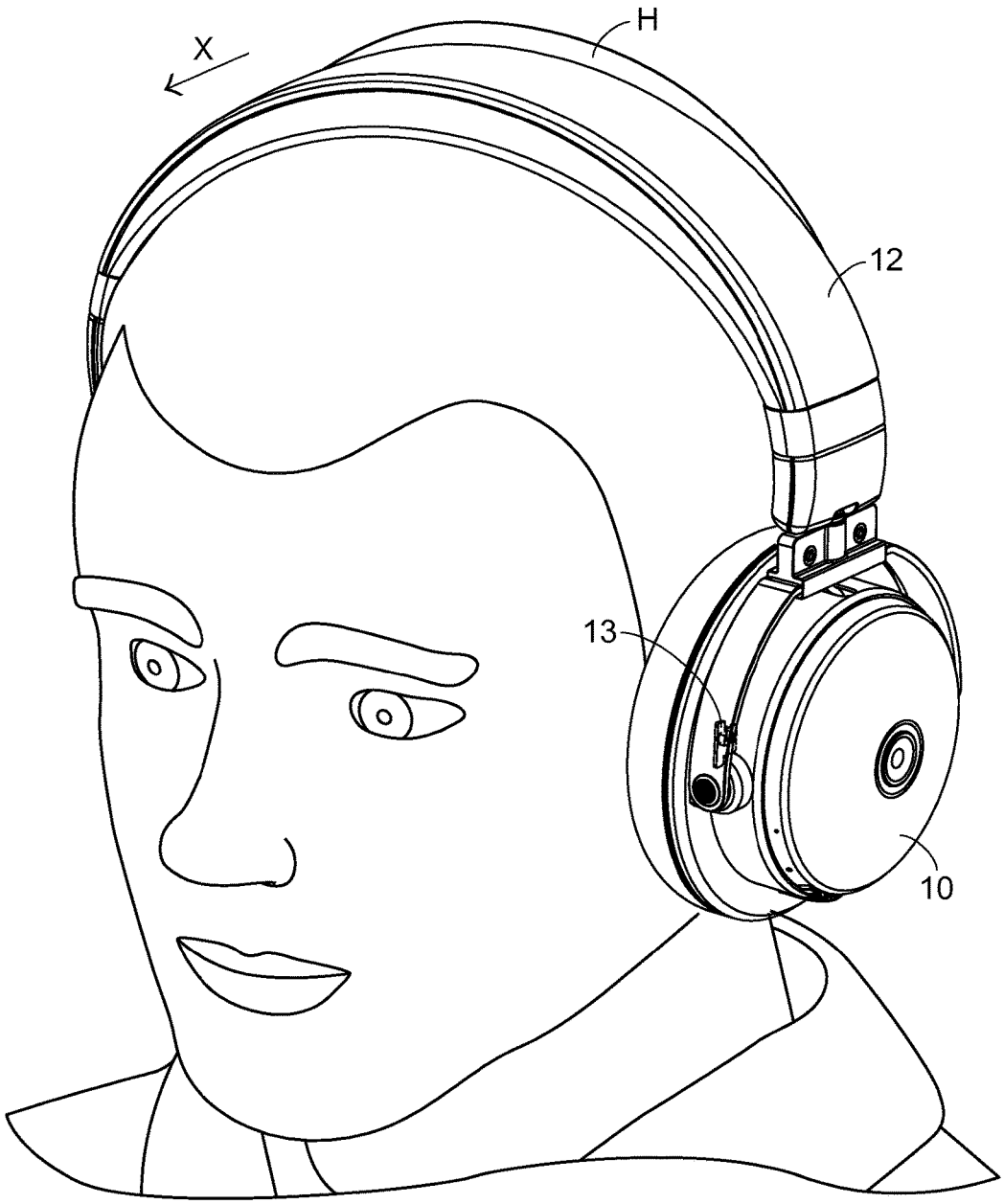
FIG. 4 schematically illustrates the usage of the headphone device according to an embodiment of the present invention, in which a sound outputting part is sheathed around a human ear.
Figure 5:
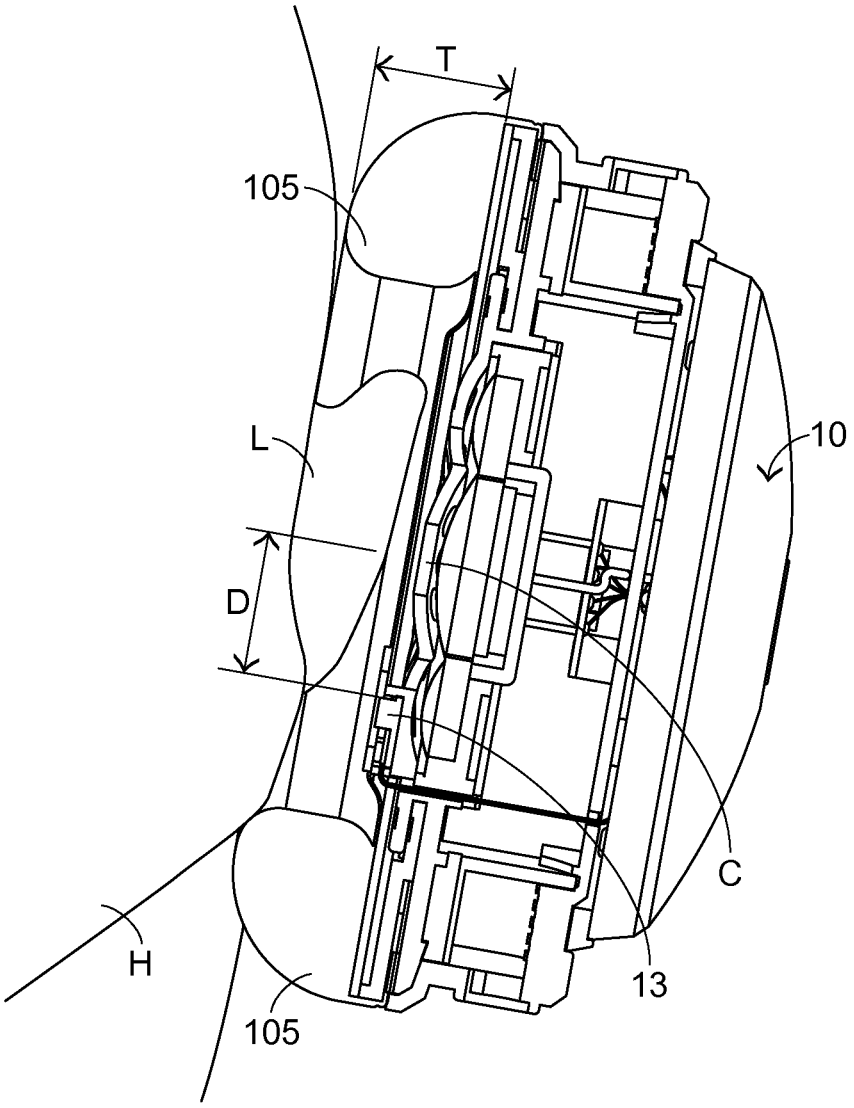
FIG. 5 is a schematic top cross-sectional view illustrating the relationship between the human ear and the sound outputting part according to an embodiment of the present invention.
Figure 6:
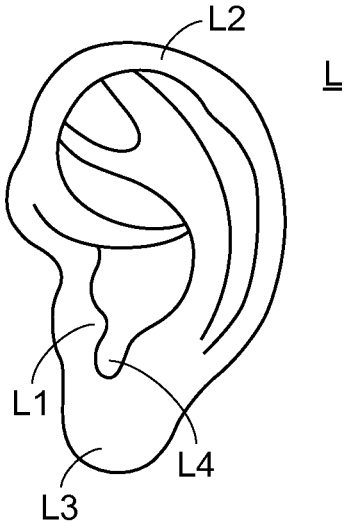
FIG. 6 schematically illustrates the structure of a left ear.

Hereinafter, the operating principles of the headphone device of the present invention will be illustrated with reference to FIGS. 4, 5 and 6. FIG. 4 schematically illustrates the usage of the headphone device according to an embodiment of the present invention, in which a sound outputting part is sheathed around a human ear. FIG. 5 is a schematic top cross-sectional view illustrating the relationship between the human ear and the sound outputting part according to an embodiment of the present invention. FIG. 6 schematically illustrates the structure of a left ear.

Please refer to FIG. 1 and FIG. 4. When the user wants to hear the audio content, the two sound outputting parts 10 and 11 are respectively sheathed around the left ear L and the right ear of the user. Consequently, the headphone device 1 can be accurately worn by the user. For clarification and brevity, the right ear of the user and the sound outputting part 11 are not shown in FIG. 4. Then, the headphone device 1 is in communication with an electronic device (not shown) through the wireless communication module 107 by a wireless transmission technology (e.g. a WiFi transmission technology or a Bluetooth transmission technology). Consequently, by controlling the electronic device, the audio content can be outputted from the headphone device 1.

As mentioned above, the sensor 13 is an optical sensor. The sensor 13 may emit a light beam to the human ear and receive the reflected light beam from the human ear. According to the result of receiving the reflected light beam, the sensor 13 can judge whether the headphone device 1 is worn by the user. For example, if the reflected light beam has not been received by the sensor for a time period shorter than a first threshold time value, the main board 106 judges that the headphone device 1 is temporarily removed by the user. Meanwhile, a corresponding control signal is transmitted to the electronic device through the wireless communication module 107. Consequently, the electronic device is controlled to temporarily cease playing the audio content or stop playing the audio content.

Moreover, if the reflected light beam has not been received by the sensor for a time period longer than the first threshold time value and shorter than a second threshold time value, the main board 106 judges that the headphone device 1 is not used by the user for a long time. Meanwhile, the wireless communication module 107 or the power module 108 of the headphone device 1 is disabled, so that the power-saving purpose is achieved.

Please refer to FIG. 4 and FIG. 5. When the head band 12 is mounted on the head H of the user, a forward direction X that the user faces is defined as a front side. Ideally, the sensor 13 is located at a front side of a center point C of the baffle plate 103 and separated from the center point C of the baffle plate 103 by a fixed distance D.

Please refer to FIG. 6. The structure of the left ear L is shown in FIG. 6. The left ear L comprises planar or protrusion structures (e.g. a tragus L1, a helix L2 and an earlobe L3) and a concave structure (e.g. an external auditory canal L4). When the headphone device 1 is worn by the user, if the sensor 13 is aligned with the concave structure (e.g. the external auditory canal L4), the distance between the sensor 13 and the external auditory canal L4 is possibly larger than a sensing distance of the sensor 13. Under this circumstance, the sensing efficacy is undesirable. For enhancing the sensing efficacy, the sensor 13 is preferably aligned with the tragus L1, the helix L2, the earlobe L3 or any other appropriate planar or protrusion structure when the headphone device 1 is worn by the user. Consequently, an optimal distance between the sensor 13 and the left ear L is maintained. That is, the distance between the sensor 13 and the left ear L is not larger than the sensing distance of the sensor 13.

When the sensor 13 is located at the front side of the center point C of the baffle plate 103 and separated from the center point C of the baffle plate 103 by the fixed distance D, regardless of how the position of the headphone device 1 is adjusted by the user, the sensing efficacy of the sensor 13 is optimized. For example, when the head band 12 is mounted on a top side, a front side or a rear side of the head H of the user and the angles of the two sound outputting parts 10 and 11 relative to the human ears are changed, the sensor 13 is aligned with the tragus L1, the helix L2 or the earlobe L3 of the left ear L. Consequently, the optimized sensing efficacy of the sensor 13 is achieved.

When the headphone device 1 is worn by the user, the human ear is surrounded by the ear pad 105. The relationship between the left ear L and the ear pad 105 is shown in FIG. 5. Consequently, the distance between the sensor 13 and the left ear L is not larger than the thickness T of the ear pad 105. In other words, the sensing distance of the sensor 13 is smaller than the thickness T of the ear pad 105. Consequently, the possibility of erroneously sensing other objects (i.e. the objects except for the left ear L) by the sensor 13 will be minimized.

If the sensor 13 receives the light beam that is not reflected from the human ear, the possibility of causing misjudgment of the sensor 13 increases. In this embodiment, an inner periphery 1051 of the ear pad 105 and the covering plate 104 are black. Under this circumstance, since the light reflectivity is reduced, the undesired reflected light beam from the inner periphery 1051 of the ear pad 105 or the covering plate 104 will be minimized.

Please refer to FIG. 1 again. A strain gage 14 is installed in the head band 12 for assisting the main board 106 in judging whether the headphone device 1 is worn by the user. In particular, if the strain gage 14 is stretched within an elastic limit, the strain gage 14 becomes thinner and longer. Consequently, the resistance between the two ends of the strain gage 14 is increased. On the other hand, if the strain gage 14 is no longer stretched, the strain gage 14 becomes thicker and shorter. Consequently, the resistance between the two ends of the strain gage 14 is decreased. According to the change of the resistance, the main board 106 can judge whether the head band 12 is stretched. Generally, if the head band 12 is stretched, it means that the headphone device 1 is worn on the head H of the user. On the other hand, if the head band 12 is not stretched, it means that the headphone device 1 is not worn on the head H of the user. Consequently, the main board 106 can judge whether the headphone device 1 is accurately worn by the user in a more precise manner.

From the above descriptions, the sensor 13 installed on the baffle plate 103 is used to sense whether the human ear is near the sensor 13, thereby judging whether the headphone device 1 is accurately worn by the user. Consequently, if the headphone device 1 is not worn by the user, the electronic device is controlled to temporarily cease playing the audio content or stop playing the audio content, or the wireless communication module 107 or the power module 108 of the headphone device 1 is disabled. In other words, the headphone device 1 is a user-friendly and power-saving circumaural headphone device.

Moreover, the sensor 13 is installed on the baffle plate 103, and the sensing distance of the sensor 13 is smaller than the thickness T of the ear pad 105. Consequently, if the ear pad 105 is placed on a desk surface or if the headphone device 1 is worn on the neck of the user and the headphone device 1 is in contact with the neck or the chin of the user, the sensor 13 will not sense the human body. Under this circumstance, the sensor 13 will not erroneously judge that the headphone device 1 is worn by the user. Moreover, since the sensor 13 is installed on the baffle plate 103, the user is not in contact with the sensor 13 when the headphone device 1 is worn by the user. That is, the user does not have the foreign body sensation. Moreover, since the sensor 13 is installed on the baffle plate 103, the relative positions of the baffle plate 103 and the main board 106 are helpful to the assembling and wiring procedure of the sensor 13. Under this circumstance, the process yield of the headphone device is not reduced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all such modifications and similar structures.

What is claimed is:

1. A headphone device, comprising:

at least one sound outputting part, wherein each sound outputting part comprises a case, a main board, a driving unit, a baffle plate and an ear pad, wherein the main board is accommodated within the case, the driving unit is accommodated within the case and connected with the main board and allows the headphone device to generate sound, the baffle plate covers the driving unit and avoids sound field interference, and the ear pad covers the baffle plate and has a ring-shaped structure, wherein when the headphone device is worn by a user, the ear pad is in contact with a corresponding human ear; and a sensor installed on the baffle plate, uncovered by the ear pad and connected with the main board, wherein if the human ear is sensed by the sensor, the main board judges that the headphone device is worn by the user, wherein if the human ear is not sensed by the sensor, the main board judges that the headphone device is not worn by the user;

wherein the headphone device further comprising a covering plate, wherein the covering plate is arranged between the baffle plate and the ear pad, and the covering plate comprises a perforation, wherein the sensor is exposed through the perforation, and wherein a sensing distance of the sensor is smaller than a thickness of the ear pad.

2. The headphone device according to claim 1, wherein if the human ear is not sensed by the sensor for a time period shorter than a first threshold time value, the main board judges that the headphone device is temporarily not worn by the user, so that the main board issues a corresponding control signal to an electronic device, wherein according to the control signal, the electronic device temporarily ceases playing an audio content or stops playing the audio content.

3. The headphone device according to claim 2, wherein if the human ear is not sensed by the sensor for a time period longer than the first threshold time value and shorter than a second threshold time value, the main board judges that the headphone device is not worn by the user for a long time, and the main board disables a wireless communication module or a power module of the headphone device.

4. The headphone device according to claim 1, wherein the sensor is located at a front side of a center point of the baffle plate, and separated from the center point of the baffle plate by a fixed distance, and wherein the at least one sound outputting part comprises two sound outputting parts, and the two sound outputting parts are connected with each other through a head band, wherein when the two ear pads of the two sound outputting parts are respectively sheathed around the two human ears and the head band is mounted on a head of the user, a forward direction that the head faces is defined as the front side.

5. The headphone device according to claim 1, wherein the at least one sound outputting part comprises two sound outputting parts, and the two sound outputting parts are connected with each other through a head band, wherein the headphone device further comprises a strain gage, and the strain gage is installed in the head band, wherein if the strain gage senses that the headband is stretched, the main board judges that the headphone device is worn by the user.

6. The headphone device according to claim 1, wherein the sensor is an optical sensor.

7. The headphone device according to claim 1, wherein the covering plate is black, so that light reflectivity is reduced.

8. The headphone device according to claim 1, wherein an inner periphery of the ear pad is black, so that light reflectivity is reduced.

9. The headphone device according to claim 1, wherein the headphone device further comprises a wireless communication module and a power module, which are disposed within the case and connected with the main board.

10. The headphone device according to claim 1, wherein the baffle plate comprises plural openings that allow the sound to pass through.

11. The headphone device according to claim 1, wherein an inner portion of the ear pad is stuffed with a sponge material, and an outer surface of the ear pad is made of leather or cloth.

* * * * *